United States Patent [19]

Bucher et al.

[11] Patent Number: 5,002,096

[45] Date of Patent: Mar. 26, 1991

[54] HEDDLE FRAME ACTUATING APPARATUS WITH FLEXURE SPRING

[75] Inventors: Robert Bucher, Frick, Switzerland; Helmut Macho, Konstanz, Fed. Rep. of Germany; Horst Schultz; Georg Schuon, both of Laupheim, Fed. Rep. of Germany

[73] Assignee: Sulzer Brothers Limited, Winterthur, Switzerland

[21] Appl. No.: 416,159

[22] Filed: Oct. 2, 1989

[30] Foreign Application Priority Data

Oct. 4, 1988 [CH] Switzerland ..... 03686/88

[51] Int. Cl.[5] ..... D03C 13/00

[52] U.S. Cl. ..... 139/57; 139/82

[58] Field of Search ..... 139/57, 82, 83, 84, 139/85, 86, 87, 88, 91, 58, 55.1, 56; 267/149

[56] References Cited

U.S. PATENT DOCUMENTS

| | | | |
|---|---|---|---|
| 3,949,788 | 4/1976 | Speich | 139/57 |
| 4,391,304 | 7/1983 | Taylor | 139/100 |
| 4,802,659 | 2/1989 | Hope | 267/149 |
| 4,877,060 | 10/1989 | Froment et al. | 139/88 X |

FOREIGN PATENT DOCUMENTS

| | | | |
|---|---|---|---|
| 0543725 | 9/1959 | Belgium . | |
| 0133966 | 3/1985 | European Pat. Off. | 139/82 |
| 380032 | 9/1909 | France | 139/84 |
| 0613527 | 11/1926 | France . | |
| 4734674 | 8/1972 | Japan . | |
| 549668 | 5/1974 | Switzerland | 139/57 |
| 505161 | 5/1939 | United Kingdom | 139/57 |

*Primary Examiner*—Andrew M. Falik

*Attorney, Agent, or Firm*—Kenyon & Kenyon

[57] ABSTRACT

A heddle frame actuator device is provided for a negative or positive heddle frame drive. The actuator device employs at least one flexure spring for imposing a spring force vertically on and in the plane of the heddle frame. In some embodiments, a pair of flexure springs, for example of U-shape, Y-shape and endless loop shape may be used. The ends of the springs connected to the loom frame may also be adjusted so that the prestressing of the springs can be varied.

24 Claims, 5 Drawing Sheets

HEDDLE FRAME ACTUATING APPARATUS WITH FLEXURE SPRING

Figure 1:
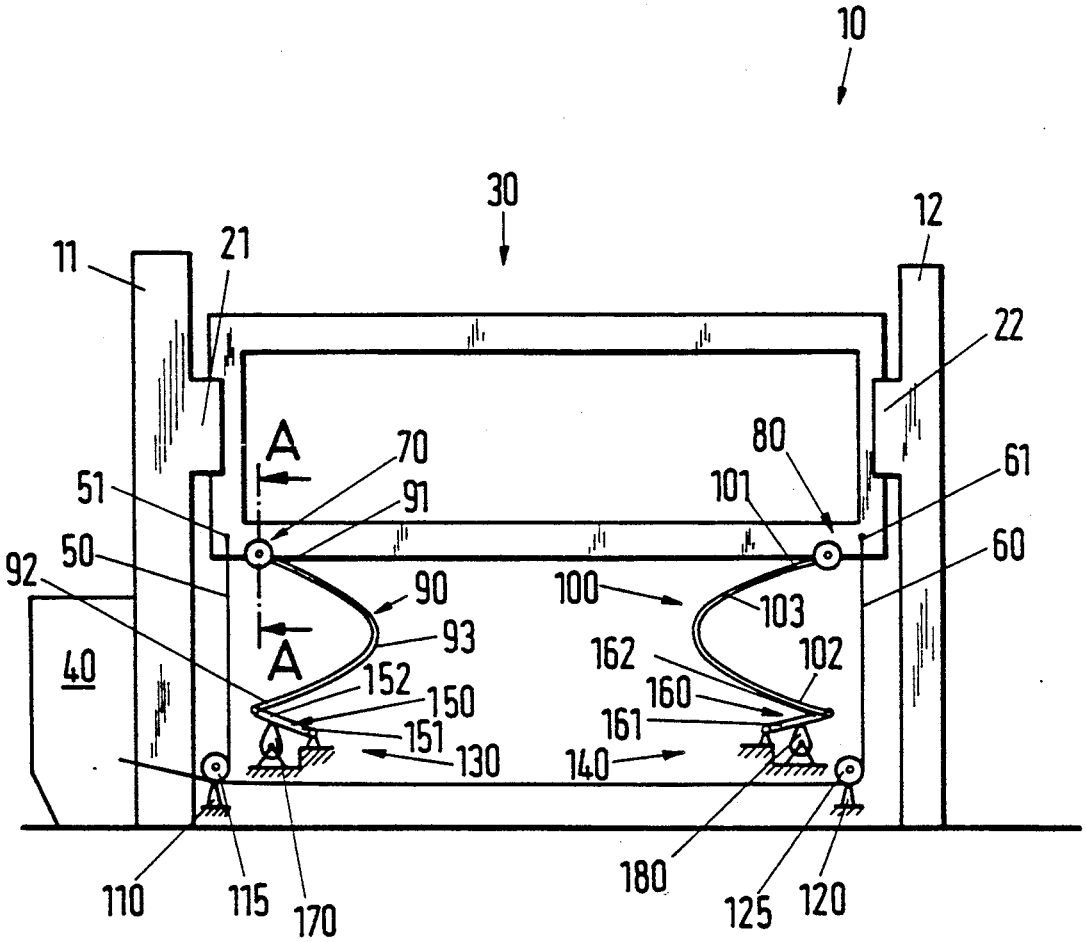

This invention relates to a heddle frame actuating apparatus.

As is known, various types of actuators have been provided in looms for transmitting the driving movement of a shedding motion to a heddle frame. of the loom. Generally, these actuators are provided in order to raise and lower the heddle frame and, in many cases, employ springs for moving the heddle frame in one direction or another.

Usually, the heddle frame actuators which employ springs are used for a negative heddle frame drive. In this case, the spring-operated actuating elements are disposed between the loom and the heddle frame and are stressed by the movement thereof in one direction to provide a drive for the return movement of the heddle frame.

As a rule, spring-operated actuators of this kind have spring registers which can be stretched over deflecting levers and which have ten or more tension springs disposed in coplanar and parallel relationship to one another. Consequently, the diameter of each discrete spring and, therefore, the width of the spring register can, for a given spring force, be less than heddle frame width. Hence, the registers can be arranged compactly, for example below the heddle frame without any need to increase the distance between heddle frames.

An arrangement of this kind can also be used in a positive heddle frame drive in which both the outwards and return movements of the heddle frame are produced by an actuating element connected to the shedding motion. In this case, the bearings, pivots, places of articulation and the like of the actuating element are in a permanently prestressed state, so that clearance and therefore wear, more particularly in connection with the reversal of heddle frame movement, are reduced.

However, the use of spring registers and the associated mechanism is excessively costly in production and assembly. Also, a complicated heddle-actuating mechanism runs counter to endeavors to produce compact looms and to simplify servicing.

Japanese publication 34675/72 discloses heddle-actuating elements of a heddle-actuating mechanism which operate by spring pressure in the end position of a heddle frame. The elements are in the form of spring strips which are disposed in pairs at the same height, move towards the heddle frame from the sides of the loom and are clamped to one long side of the heddle frame by way of horizontal end portions. The spring strips brake the heddle frame as the frame moves into an end position and, by their deformation, store energy which is released upon the destressing of the springs and helps to accelerate the heddle frame towards the other end position. Heddle frame actuation at the reversal of heddle frame movement is therefore facilitated considerably, so that a route to a simplified actuating mechanism is opened up.

What is usually found to be disadvantageous with this arrangement is that, contrary to the general trend towards mechanically simplified and increasingly compact looms, additional heddle frame actuator elements are provided which can be operative only in the end positions of the heddle frame. A particular disadvantage is that the spring strips may apply bending moments to the heddle frame in addition the vertical forces for accelerating the frame. Consequently, if spring strips are used as the main spring drive in a negative form of heddle actuation, stressing in the heddle frame reaches values such that only ruggedly constructed heddle frames can be used.

This is undesirable. In the first place, if the heddle frame cannot be strengthened appropriately with a very reduced weight increase, a vicious circle arises of weight increase leading to a correspondingly necessary increase in the accelerating spring force leading to further stressing in the heddle frame leading to a further weight increase. Second, the aim of a constructional improvement in the heddle frame, if attainable, should be not to compensate for new disadvantages but to be directly usable as is the case, for example, when a lighter-weight heddle frame enables the loom to operate faster.

Other types of spring containing mechanisms are also known, for example from Belgium Patent 453,725, French Patent 613,527 and Japanese Patent Publication 34674/1972. In the first case, the Belgium patent describes the use of spiral springs which are located in an overhead manner relative to a heddle frame and are connected by ropes with the heddle frame. The French patent describes the use of torsion springs located at the sides of a heddle frame for biasing the frame in one or another direction relative to an actuating mechanism. The Japanese patent publication describes the use of torsion and flexure springs as shock absorbers for a heddle frame.

Accordingly, it is an object of the invention to provide a heddle frame actuator device for driving a heddle frame by means of actuating elements of simplified rugged construction having a width that does not exceed the width of the heddle frame.

It is another object of the invention to provide a simplified arrangement for the driving of a heddle frame.

It is another object of the invention to be able to use lightweight heddle frames in a loom.

It is another object of the invention to simplify the spring mounting of a heddle frame in a loom.

Briefly, the invention is directed to a heddle frame which is movably mounted in a loom frame and which has a driving means for moving the heddle frame in at least a first direction in the loom frame. In accordance with the invention, a spring means is disposed vertically between the heddle frame and the loom frame for biasing the heddle frame in a second direction opposite the first direction. This spring means includes at least one flexure spring for imposing a spring force vertically on the heddle frame.

The flexure spring is characterized in being resiliently deformable over at least part of the length thereof and is located in a self-supporting manner between the heddle frame and loom. The spring is arranged so that the point at which the spring contacts the heddle frame and the point at which the spring contacts the loom are disposed on a common vertical line.

In one embodiment, the spring means is composed of a pair of flexure springs disposed between the heddle frame and loom frame symmetrically of a central vertical plane of a heddle frame. In addition, each flexure spring is of generally U-shape having one end pivotally connected to the heddle frame while the opposite end is connected to the loom frame. Both of these ends are disposed in a common vertical line. In one case, the flexure springs may be bent towards each other while in another case, the springs may be bent away from each other.

A means may also be provided at the end of each spring connected to the loom frame for imposing a selectively variable prestressing force thereon. Such a prestressing means may include an eccentric for varying the distance between the end of the spring and the loom frame in order to vary the prestressing force on the spring. Alternatively, the prestressing means may be connected in common to the ends of the two springs for imposing a prestressing force simultaneously thereon. In one case, this prestressing means may include a pair of rockers which are pivotally mounted on the loom and disposed in meshing relation at one end with each other. Each rocker is also pivotally connected at an opposite end to a respective spring. Alternatively, use may be made of a pair of discs which are rotatably mounted on the loom frame and pivotally connected to a respective spring. In this case, a lever is also pivotally connected to and between the discs for synchronous rotation of the discs.

In still another embodiment, a single spring is connected at an intermediate point to the heddle frame while the ends of the spring are connected to the loom frame, for example via a prestressing means.

In still another embodiment, the spring means includes a pair of springs disposed symmetrically between the heddle frame and loom frame with each spring being of endless loop shape.

In still another embodiment, a spring means may be composed of a pair of V-shaped springs disposed symmetrically between the heddle frame and loom frame. In this case, each spring has one end pivotally connected to the heddle frame and another end pivotally connected to the loom frame. In addition, an abutment element is provided for limiting resilient return deformation of each respective spring. For example, the abutment element may be in the form of a stroke limiter which engages around a respective spring and has a predetermined opening therefore.

The drive means for driving the heddle frame may employ a single cable which is attached to the heddle frame at a midpoint, for example, between two flexure springs. Alternatively, use may be made of a pair of cables attached to opposite lateral ends of the heddle frame. Still further, the drive means may be articulated to the heddle frame for reciprocating the frame relative to the loom frame in opposite directions.

With the various embodiments, the flexure spring which acts on the heddle frame exerts only vertical forces and therefore has the advantageous effect of conventional actuating elements having tension spring registers and correspondingly causes minimal stressing in the heddle frame. Consequently, for example, the heddle frame can be a lightweight construction with all the associated advantages. Also, a flexure spring having a transverse dimension approximately corresponding to heddle frame width can receive considerable forces, so that a single flexure spring directly associated with the heddle frame can replace a tension spring register with its associated deflecting levers, pull elements or the like, so that the mechanism for actuating the heddle frame is simplified considerably.

Figure 2:
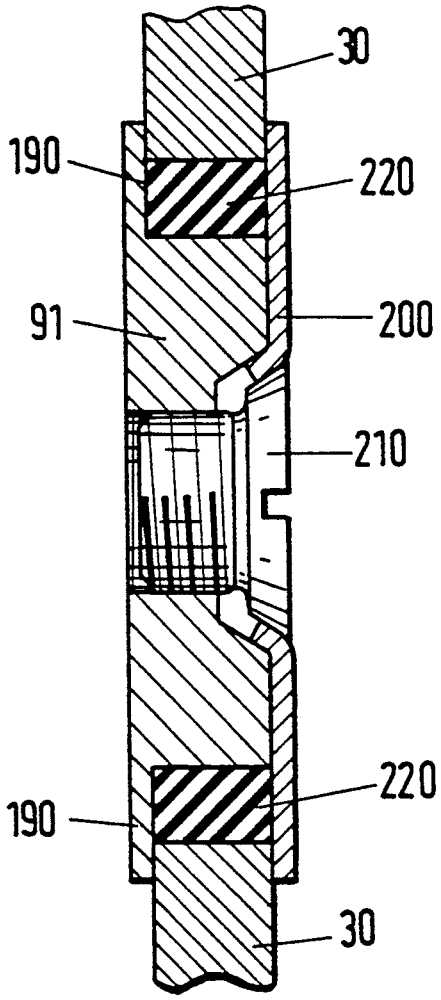
Figure 3A:
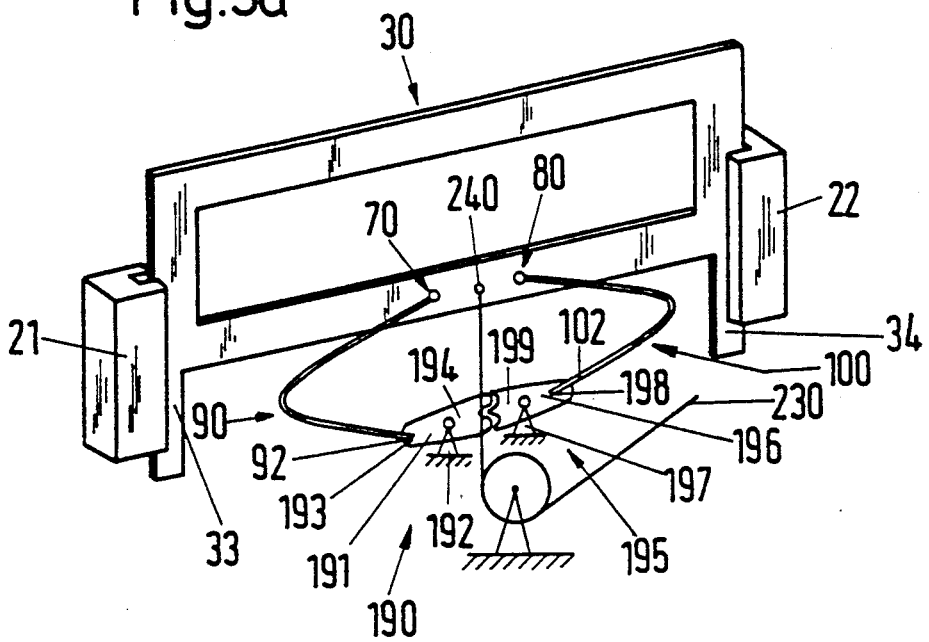
Figure 3B:
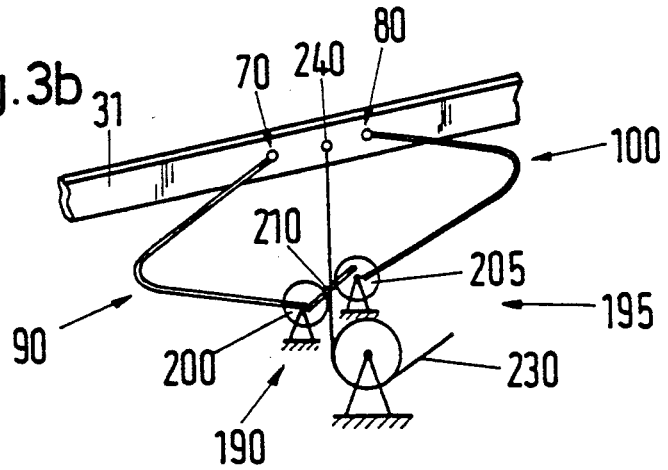
Figure 3C:
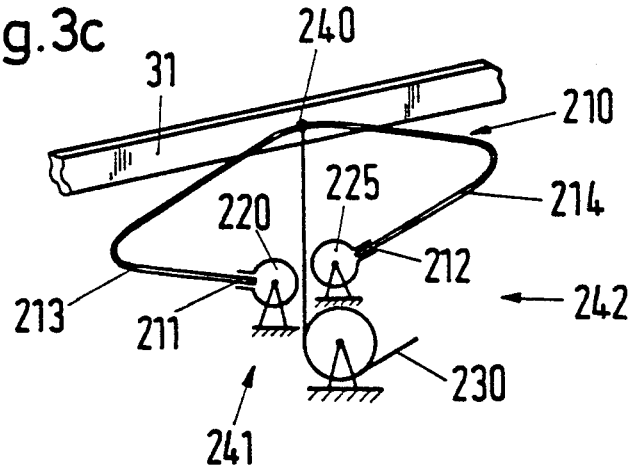
Figure 4:
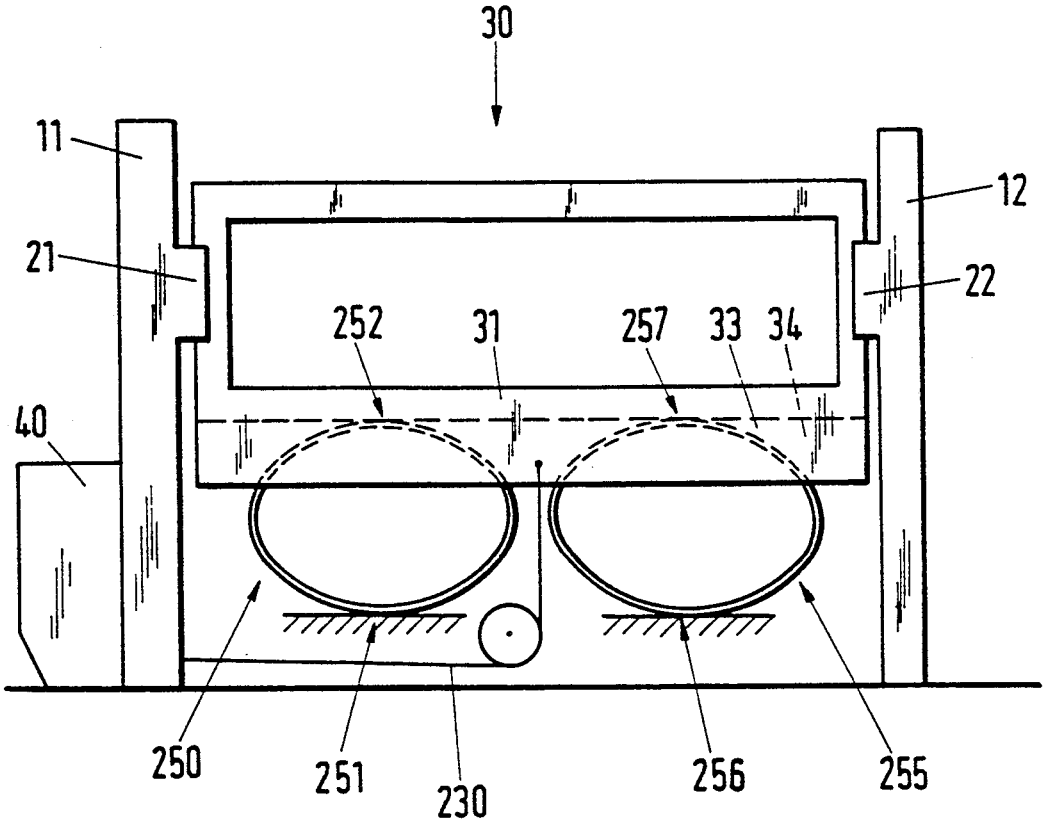
Figure 5:
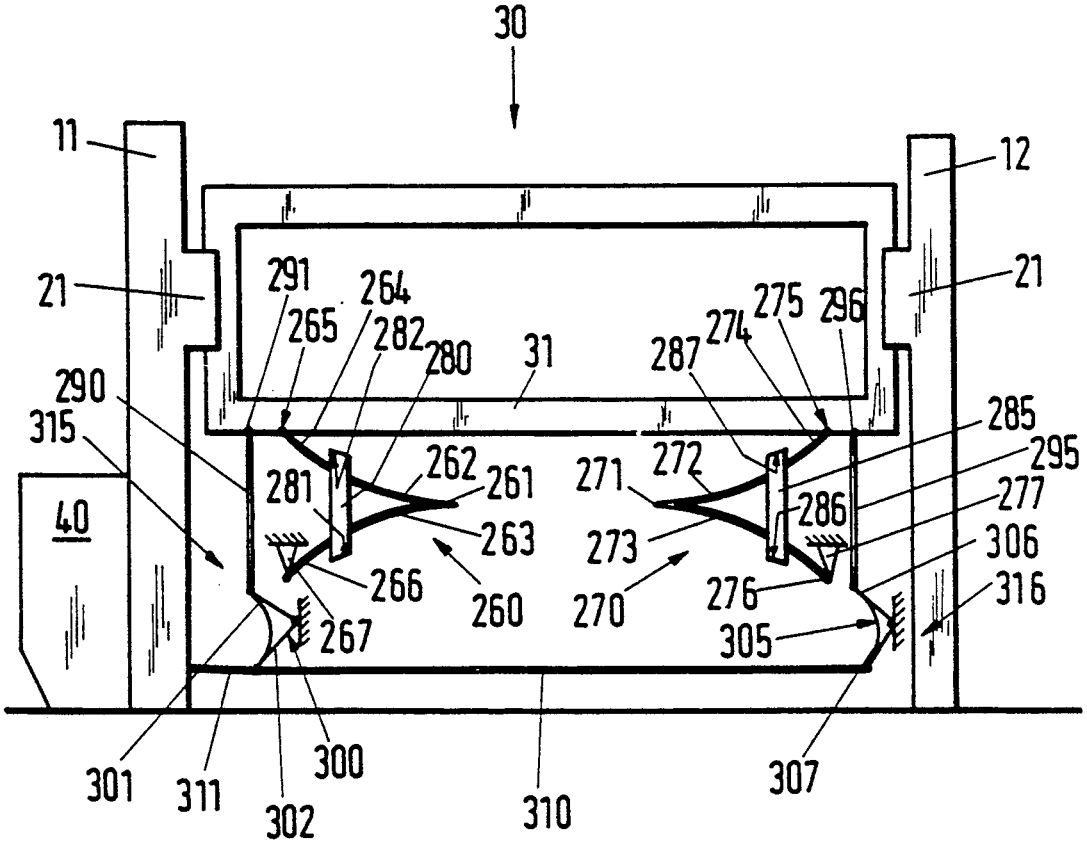

These and other objects and advantages of the invention will become more apparent from the following detailed description taken in conjunction with the accompanying drawings wherein:

FIG. 1 diagrammatically illustrates a spring arrangement for actuating a heddle frame in a loom frame in accordance with the invention;

FIG. 2 illustrates a view taken on line A—A of FIG. 1;

FIG. 3*a* diagrammatically illustrates a modified spring means and prestressing means for a heddle frame in accordance with the invention;

FIG. 3*b* illustrates a modified prestressing arrangement in accordance with the invention;

FIG. 3*c* diagrammatically illustrates a heddle frame connected to a single flexure spring in accordance with the invention;

FIG. 4 illustrates a heddle frame actuating device employing a pair of springs of endless loop shape in accordance with the invention; and FIG. 5 illustrates a further modification in accordance with the invention utilizing V-shaped springs.

Referring to FIG. 1, a loom 10 which is not further detailed includes a frame having a pair of side walls 11, 12, each of which has a guide 21, 22, respectively for slidably receiving a vertically reciprocable heddle frame 30 therebetween. In addition, a drive means is provided for moving the heddle frame 30 in a downward vertical direction within the guides 21, 22. This drive means include a shedding motion 40 which provides the driving movement and a pair of actuating elements in the force of pull cables 50, 60 which are connected to the heddle frame 30 at connection places 51, 61. As indicated, the cables 50, 60 are connected with the shedding motion 40. The drive is thus in the form of a negative heddle frame drive.

In addition, a spring means in the form of a pair of generally U-shaped flexure springs 90, 100 are disposed vertically between the heddle frame 30 and the loom frame.

As illustrated, each cable 50, 60 passes about a roller 15, 120 in order to pull the heddle frame downwardly upon drawing of the cables 50, 60 into the shedding motion 40. Each roller 115, 125 is, in turn, mounted via a suitable mounting 110, 120 on the loom frame directly below the connection places 70, 80.

The U-shaped flexure springs 90, 100 are operative as compression springs and are disposed in the plane of the heddle frame 30 in the space below the heddle frame 30. The springs 90, 100 have ends 91, 101 pivotally connected to the heddle frame 30 and opposite ends 92, 102 connected to the loom frame at respective connection places 130, 140. As indicated, the ends of the respective springs 90, 100 are disposed on a common vertical line.

As indicated, the springs 90, 100 serve to bias the heddle frame 30 in the upwardly direction via forces imposed at the connection places 70, 80.

The connection places 70, 130 on the one hand and 80, 140 on the other hand are disposed near the side walls 11, 12 respectively so that the two springs 90, 100 are arranged symmetrically of a vertical plane between them. Also, the spring ends 90, 91, 101, 102 are adapted to pivot freely in the connection places 70, 80, 130, 140 while the main bodies 93, 03 of the springs which are bent towards each other are resiliently deformable over their entire length and extend self-supportingly between the pivoted connections at their ends.

As illustrated, a prestressing means is disposed at each connection place 130, 140 of the springs 90, 100 for imposing a selectively variable prestressing form on each spring 90, 100. As illustrated, each means includes an eccentric 170, 180 for varying the distance between the opposite end of a spring 90, 100 and the loom frame in order to vary the prestressing force on the springs 90, 100. In addition, a transfer lever 150, 160 is pivotally connected at one end 152, 162 to the end 92, 102 of a spring 90, 100 while being pivotally connected at an opposite end 151, 161 to the loom frame. As indicated, each transfer lever 150, 160 is biased against the respective eccentric 170, 180. Thus, any rotation of the eccentrics 170, 180 varies the spacing between the spring ends 91, 92; 101, 102. This serves to vary the prestressing of the springs and aids in providing a predeterminable heddle frame acceleration which is optimal for a particular weaving procedure.

When the shedding motion 40 is pulling on the cables 50, 60, the heddle frame 30 moves against the force exerted by the springs 90, 100 and compresses the springs. The self-supporting main spring members 93, 103 can move out towards the space between them, with the result that the connection places 70, 80 do not experience any undesirable lateral forces. Also, the spring ends 91, 92, 101, 103 pivotally connected to the places 70, 80, 130, 140 execute a corresponding pivoting motion so that the bending movements which build up in the springs cannot be effective on the heddle frame 30. Consequently, only vertically acting components of the force of the springs 90, 100 act on the heddle frame 30.

Referring to FIG. 2 which is representative of the pivot connections of each spring ends to a respective heddle frame or loom frame is similar. For example, the spring end 91 engages in tongs fashion about a part of the heddle frame 30 and has a collar 190 integral therewith. In addition, a locking plate 200 is secured to the spring end 91 by a screw 210 so as to locate the spring end 91 on the heddle frame 30. A ring 220 made of a slidable or elastomeric substance is disposed between the spring end 91 and the heddle frame 30 to be effective as the transmission element of vertical forces and also as a pivot element of the pivot connection. Since this connection is devised to transmit vertical forces, the ring 220 and plate 200 are therefore effective only as a means for securing against lateral sliding, so that clamping to the edge of the heddle frame is unnecessary and the flexure spring 91 can therefore turn freely relatively to the heddle frame 30.

Referring to FIG. *3a*, wherein like reference characters indicate like parts as above, the flexure springs 90, 100 may be bent away from each other while utilizing a common prestressing means. As illustrated, this prestressing means includes a pair of rockers 191, 196 each of which is mounted on the loom frame by a mounting 192, 197 and pivotally connected at the outer end 193, 198 to the end 92, 102 of a respective flexure spring 90, 100. Since the connection places 190, 195 of the loom are so close together, the inner ends 194, 199 of the rockers 191, 196 are in meshing relation by way of a suitable toothing so that the rockers 191, 196 can be adjusted symmetrically. In addition, suitable means (not shown) are provided for clamping the rockers 191, 196 fast in the respective mountings so that shifting does not occur when the rockers are loaded.

Referring to FIG. *3b*, the prestressing means may be in the form of a pair of discs 200, 205, each of which is rotatably mounted on the loom frame and each of which is pivotally connected to a respective spring 90, 100. In addition, a lever 210 is pivotally connected between and to the discs 200, 205 for synchronous rotation thereof.

Referring to FIG. *3c*, the spring means may be in the form of a single flexure spring 210. In this case, the spring 210 is connected at an intermediate point 240 at the midpoint of the bottom rail 31 of the heddle frame as well as two ends 211, 212 which are rigidly clamped in rotatable discs 220, 225 at connection places 241, 242 on the loom frame. Because of the firm clamping, lateral forces are active on the spring ends 211, 212, thus enabling spring behavior to be varied over a very wide range. The symmetrical arrangement of the two spring arms 213, 214 relative to the vertical by way of the connection place 240 on the heddle frame ensures that the lateral forces and any moments arising at the place 240 cancel one another so that only vertical forces act on the heddle frame 30.

A feature common to the embodiments shown in FIGS. *3a–3c* is that the connection places 70, 80; 240 of the springs 90, 100; 210 on the heddle frame are in the central zone of the long side 31 of the loom frame. In addition, a single actuating element is connected to the shedding motion in the form of a pull cable 230 disposed in a central zone of the long side 31 of the frame 30. Consequently, those places in the heddle frame 30 which are usually stressed simultaneously in compression by the springs 90, 100; 210 and in tension by the cable 230 are closer together, a feature which is advantageous for the stressing of the heddle frame 30. Another advantage is that a single pull cable 230 is sufficient to actuate the heddle frame 30. Since the movement forces act at the center of the long side of the frame 30, there is no risk of the frame 30 being tilted by elongation of the heddle frame sides 33, 34 (FIG. *3a*) which move in the guides 21, 22.

Referring to FIG. 4 wherein like reference characters indicate like parts as above, the actuator device for a heddle frame 30 is constructed for a negative heddle frame drive. In this case, use is made of flexure springs 250, 255 which are of endless loop shape. The springs 250, 255 are borne by way of connection places 251, 256 on the loom frame and connection places 252, 257 on the heddle frame 30 and are trapped and therefore laterally stabilized on the heddle frame 30 by wall parts 33, 34 which project from the bottom of the long side 31 of the heddle frame 30. The parts 33, 34, although of very simple construction, help to strengthen the long side 31 of the heddle frame, and so the places where the forces exerted by the flexure springs and the single pull cable 230 are applied can be further apart from one other. This consideration is of particular significance since the circular springs, which are double as compared with U-shaped springs, produce considerable spring forces for substantial accelerations of the heddle frame.

FIG. 5 shows an actuator device which is of use for a positive heddle frame drive and which has flexure springs in the form of V-shaped springs 260, 270. Each spring 260, 270 has arms 262, 263 and 272, 273 respectively which converge at a respective apex 261, 271 and which are pivotally connected by way of ends 264, 274 respectively to connection places 265, 275 on the long side 31 of the heddle frame 30 and by way of respective ends 266, 276 to mountings 267, 277 of the loom frame. Abutment elements for limiting the resilient return deformation of the springs 260, 270, for example in the form of stroke limiters 280, 285, are disposed on the arms 263, 273 and have abutment surfaces 281, 282, 286, 287 which engage around the spring arms 262, 263 at a distance therefrom after the fashion of a clamp or clip or the like. Each limiter 280, 285 has a predetermined opening for this purpose.

The drive means also has lifting rods 290, 295 pivotally connected at one end to connection places 291, 296 of the heddle frame 30 and at the other end to one arm 301, 306 of toggles 300, 305 mounted on the loom frame. The other arms 302, 307 of the toggles are pivotally connected to an actuating rod 310 connected by way of a transmission portion 311 to the shedding motion 40. This arrangement in which at least one actuator element 315, 316 is operative in the direction of the spring forces provides a permanent prestressing in the conventional positive heddle frame drive 40, 311, 310, 300, 305, 290, 295, and so all the articulations of the drive are relieved of load and there is no play in the heddle frame movement. The stroke limiters 280, 285, prevent excessive destressing of the springs 260, 270, thus considerably facilitating manipulation of the heddle frame, for example, when the heddle frame is changed.

Not illustrated is an embodiment for varying the prestressing of the flexure springs by means of an eccentric or the like acting directly on the corresponding flexure spring end. Such an arrangement has the advantage of simple construction. An adjusting drive for the eccentrics 170, 180 shown in FIG. 1 is preferably in the form of a belt or chain or rod actuation to ensure uniform adjustment of the eccentrics 170, 180. In the event the flexure spring ends 92, 102 or transfer levers 150, 160 are not disposed substantially horizontally above the eccentric 170, 180, a crossover drive is advantageous since such provides adjustment of the eccentrics 170, 180 in opposite directions. The symmetry thereby maintained in respect of a vertical line between the spring ends 92, 102 ensures that the same are adjusted uniformly, something which does not happen when, for example, identical eccentrics 170, 180 act in the same direction of rotation on differently inclined transfer levers 150, 160. Preferably, the flexure springs 90, 100 are made of fiber-reinforced plastics.

The invention thus provides an actuator device for a heddle frame in a loom which permits the use of a lightweight heddle frame. Further, the spring forces provided by the actuator device act vertically within the plane of the heddle frame so that twisting forces are not imposed upon the heddle frame.

What is claimed is:

1. In combination, a loom frame;

a heddle frame mounted for vertical movement in said loom frame;

drive means for moving said heddle frame in a first vertical direction in said loom frame; and spring means vertically positioned between said heddle frame and said loom frame for biasing said heddle frame in a second direction opposite said first direction, said spring means including at least one flexure spring for imposing a spring force vertically on said heddle frame.

2. The combination as set forth in claim 1 wherein said spring means includes a pair of flexure springs disposed between said frames symmetrically of a central vertical plane of said heddle frame.

3. The combination as set forth in claim 2 wherein each flexure spring is of generally U-shape having one end pivotally connected to said heddle frame and an opposite end connected to said loom frame.

4. The combination as set forth in claim 3 wherein said ends are disposed in a common vertical line.

5. The combination as set forth in claim 3 wherein said springs are bent towards each other.

6. The combination as set forth in claim 3 wherein said springs are bent away from each other.

7. The combination as set forth in claim 3 which further comprises means at said second end of each spring for imposing a selectively variable prestressing force thereon.

8. The combination as set forth in claim 7 wherein each said prestressing means includes an eccentric for varying the distance between said opposite end of a respective spring and said loom frame to vary the prestressing force on said respective spring.

9. The combination as set forth in claim 8 wherein each prestressing means includes a transfer lever pivotally connected to and between said loom frame and said opposite end of a respective spring and biased against said eccentric of said prestressing means.

10. The combination as set forth in claim 3 which further comprises means connected in common to said second end of each spring for imposing a selectively variable prestressing force thereon.

11. The combination as set forth in claim 10 wherein said prestressing means includes a pair of rockers pivotally mounted on said loom frame and disposed in meshing relation at one end thereof, each rocker being pivotally connected at one end to a respective spring.

12. The combination as set forth in claim 10 wherein said prestressing means includes a pair of discs rotatably mounted on said loom frame, each disc being pivotally connected with a respective spring and a lever pivotally connected to and between said discs for synchronous rotation thereof.

13. The combination as set forth in claim 1 wherein said spring is disposed in a vertical plane of said heddle frame.

14. The combination as set forth in claim 1 wherein said spring is connected at an intermediate point to said heddle frame and which further comprises a pair of rotatable discs mounted on said loom frame, each disc being pivotally connected to a respective end of said spring.

15. The combination as set forth in claim 1 wherein said spring means includes a pair of springs disposed between said frames in symmetrical relation, each spring being of endless loop shape.

16. The combination as set forth in claim 1 wherein said spring means includes a pair of V-shaped springs disposed symmetrically between said frames, each spring having one end pivotally connected to said heddle frame and another end pivotally connected to said loom frame.

17. The combination as set forth in claim 16 further comprising an abutment element limiting resilient return deformation of each respective spring.

18. The combination as set forth in claim 17 wherein said abutment element is a stroke limiter engaging around said respective spring and having a predetermined opening therefore.

19. The combination as set forth in claim 17 wherein said drive means is articulated to said heddle frame for reciprocating said heddle frame relative to said loom frame.

20. The combination as set forth in claim 1 wherein said drive means is articulated to said heddle frame for reciprocating said heddle frame relative to said loom frame.

21. The combination as set forth in claim 1 wherein said drive means includes a single cable attached to said heddle frame at a mid-point thereof.

22. The combination as set forth in claim 21 wherein said spring means includes a pair of flexure springs disposed between said frames symmetrically of a central vertical plane of said heddle frame.

23. The combination as set forth in claim 1 wherein said spring is made of fiber reinforced plastic.

24. The combination as set forth in claim 1 wherein said loom frame has a pair of sides guiding said heddle frame therebetween, said sides being of greater height than that of said heddle frame.

* * * * *

UNITED STATES PATENT AND TRADEMARK OFFICE

CERTIFICATE OF CORRECTION

PATENT NO. : 5,002,096

DATED : March 26, 1991

INVENTOR(S) : ROBERT BUCHER, et al

It is certified that error appears in the above-identified patent and that said Letters Patent is hereby corrected as shown below:

Column 3, line 40 change "therefore" to -therefor-
Column 4, line 38 change "15, 120" to -115, 125-
Column 4, line 52 change "upwardly" to -upward-
Column 4, line 60 change "03" -to -103-
Column 5, line 28 change "referring ... which" to -Fig. 2-
Column 5, line 29 change "ends" to -end-
Column 5, line 30 cancel "is similar"

Signed and Sealed this

Thirteenth Day of October, 1992

*Attest:*

DOUGLAS B. COMER

*Attesting Officer*

*Acting Commissioner of Patents and Trademarks*